US008282178B2

(12) United States Patent
Bradley et al.

(10) Patent No.: US 8,282,178 B2
(45) Date of Patent: Oct. 9, 2012

(54) NON-ENCAPSULATED REFRIGERATOR SHELF

(75) Inventors: Ryan R. Bradley, Granger, IN (US); Matthew G. Czach, Kalamazoo, MI (US); Sagar P. Kanagali, Pune, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 138 days.

(21) Appl. No.: 12/706,372

(22) Filed: Feb. 16, 2010

(65) Prior Publication Data

US 2011/0198976 A1 Aug. 18, 2011

(51) Int. Cl.
*A47B 96/04* (2006.01)
*A47B 9/00* (2006.01)

(52) U.S. Cl. ..... 312/408; 108/108

(58) Field of Classification Search ..... 312/408; 108/108, 109; 248/243, 245, 249, 250, 225.21
See application file for complete search history.

(56) References Cited

U.S. PATENT DOCUMENTS 4,334,483 A * 6/1982 Kellogg ..... 108/152
4,691,887 A 9/1987 Bessinger
4,733,843 A 3/1988 Bessinger
4,736,919 A 4/1988 Bessinger
4,736,997 A 4/1988 Besore et al.
4,738,426 A 4/1988 Bessinger
4,871,136 A 10/1989 Bessinger et al.
4,923,260 A * 5/1990 Poulsen ..... 312/408
5,020,758 A 6/1991 Rawlyk
5,064,158 A 11/1991 Brazier et al.
5,297,486 A 3/1994 Herrmann et al.
5,695,163 A 12/1997 Tayar
5,799,803 A 9/1998 Muller
6,045,101 A 4/2000 Goyette et al.
6,749,164 B2 * 6/2004 Wijnans ..... 248/244
2003/0226944 A1 12/2003 Sode
2004/0263038 A1 12/2004 Ribolzi et al.
2005/0218767 A1 10/2005 Jeong et al.
2007/0114897 A1 5/2007 Neumann

* cited by examiner

*Primary Examiner* — Darnell Jayne
*Assistant Examiner* — Timothy M Ayres
(74) *Attorney, Agent, or Firm* — Kirk W. Goodwin; Diederiks & Whitelaw PLC

(57) ABSTRACT

A refrigerator includes support rails which are positioned adjacent a back wall for supporting a plurality of removable shelf assemblies. First and second shelf support brackets project from the rails and include rear shelf support flanges spaced from support arms. A shelf panel has a back frame member including at least one support hook adapted to engage the shelf support flanges such that the back edge portion of the shelf panel is positively engaged with the shelf support brackets. At the same time, a section of a central portion of the shelf panel is supported on the support arms, while both another section of the central portion and a forward portion of the shelf panel extends in a cantilevered manner beyond the brackets.

20 Claims, 3 Drawing Sheets

NON-ENCAPSULATED REFRIGERATOR SHELF

BACKGROUND OF THE INVENTION

1. Field of the Invention

The present invention pertains to the art of refrigerators and, more particularly, to a refrigerator shelving system for supporting a cantilevered glass shelf.

2. Description of the Related Art

Many different types of shelving systems have been provided for refrigerator compartments. For example, it is common to provide vertically adjustable storage units and/or shelves in refrigerator cabinets in order to increase the versatility of storing a wide range of food items. To this end, many fresh food compartments have elongated, vertically extending and laterally spaced rails or tracks mounted on rear walls thereof, with the rails enabling storage units to be supported in selected vertically adjustable positions. Typically, shelves for such storage units include a unitary frame member including spaced support hooks or brackets which support the entire shelf from the spaced rails. Glass shelves have become popular and are often encased in a plastic or metal frame member including shelf brackets. Alternatively, some glass shelves include a frame member on one portion of a shelf panel, with the frame member engaging shelf brackets connected directly to the back wall of a refrigerator. For example, U.S. Pat. No. 4,738,426 teaches an interface strip affixed to the rear portion of a shelf panel which is inserted within a shelf bracket. The shelf bracket fastens to the back wall of a refrigerator via fastener screws. Common problems associated with various known refrigerator shelving units include frame members which create crevices for the build-up of food and grime, difficulty in adjusting the position of the shelves, instability of the shelves, and complicated manufacturing requirements. Therefore, even with the variety of shelving units available, there is seen to be a need in the art for a refrigerator shelf which can be easily manufactured, readily adjusted, simply cleaned, stably supported and attractive in appearance.

SUMMARY OF THE INVENTION

The present invention is directed to a refrigerator and a shelf system for supporting a plurality of removable shelf assemblies within the refrigerator. The shelf system includes first and second laterally spaced support rails mounted adjacent a back wall of the refrigerator. Each support rail includes a plurality of longitudinally spaced apertures formed therein adapted to engage first and second shelf support brackets of a shelf assembly. Each shelf assembly includes a shelf panel having a back frame member attached at a back edge portion of the shelf. The back frame member includes at least one support hook adapted to engage shelf support flanges on respective shelf support brackets.

In use, the shelf bracket are mounted on respective support rails, and the support hook of the back frame member engages the respective shelf support flanges such that a back edge portion of the shelf panel is positively engaged with the shelf support brackets. At the same time, a section of a central portion of the shelf panel is supported on support arms of the brackets, while both another section of the central portion and a forward portion of the shelf panel extends in a cantilevered manner beyond the brackets. With this configuration, each shelf panel can be easily removed from the refrigerator for cleaning without the need to remove, and later re-attach, the shelf support brackets.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
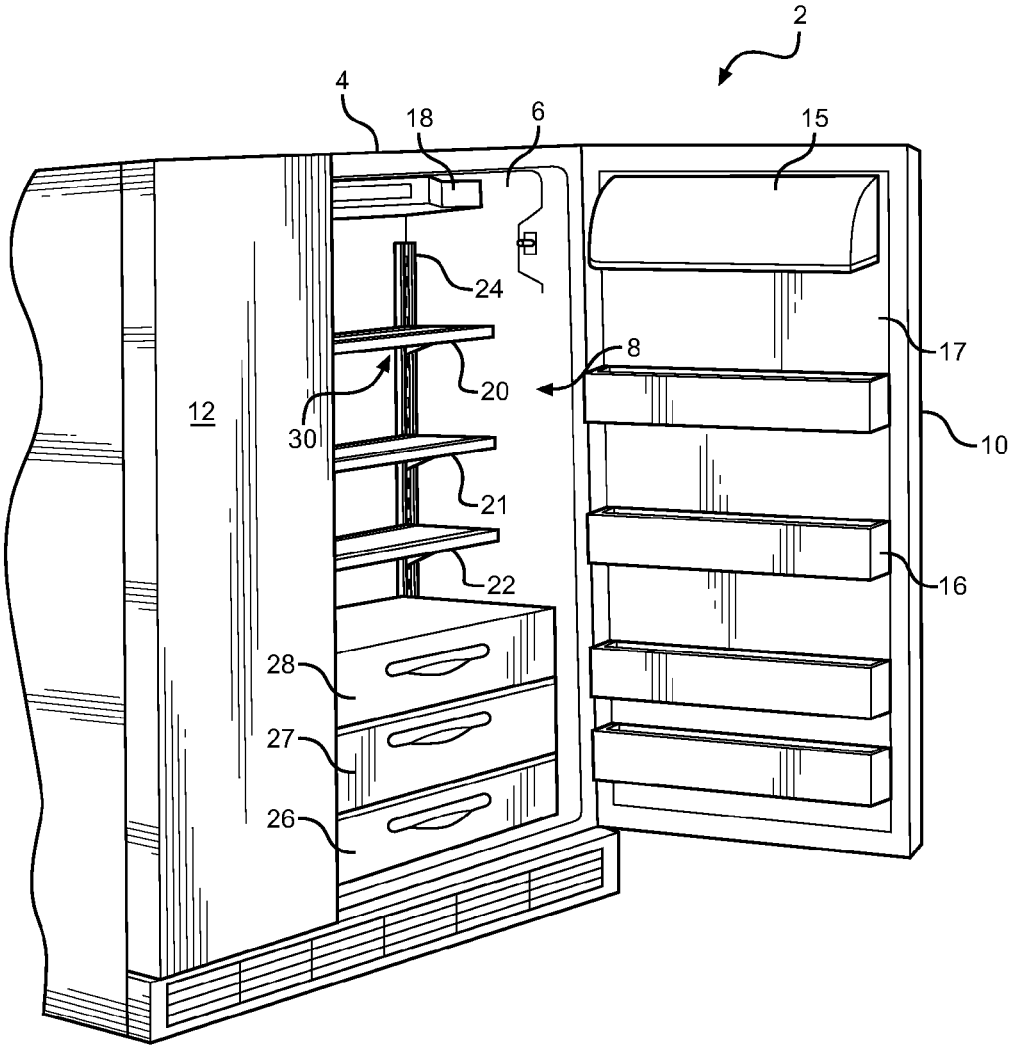
FIG. 1 is a perspective view of a refrigerator including a shelf system according to the present invention.

With initial reference to FIG. 1, a refrigerator cabinet 2 includes a cabinet shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (now shown). For the sake of completeness, door 10 of refrigerator cabinet 2 is shown to include a dairy compartment 15 and various vertically adjustable storage units, one of which is indicated at 16. As shown, storage unit 16 constitutes a pick-off bucket that can be selectively removed from a liner 17 of door 10. Mounted in an upper region of fresh food compartment 8 is a temperature control housing 18 which, in a manner known in the art, can be used to regulate the temperature in both fresh food compartment 8 and the freezer compartment (not shown). Below temperature control housing 18 are arranged a plurality of vertically spaced shelves 20-22 which are preferably mounted for selectively vertical adjustment upon spaced rear rails, one of which is indicated at 24. At a lowermost portion of fresh food compartment 8 are illustrated a lowermost bin 26 and higher, individually temperature controlled bins 27 and 28.

Figure 2:
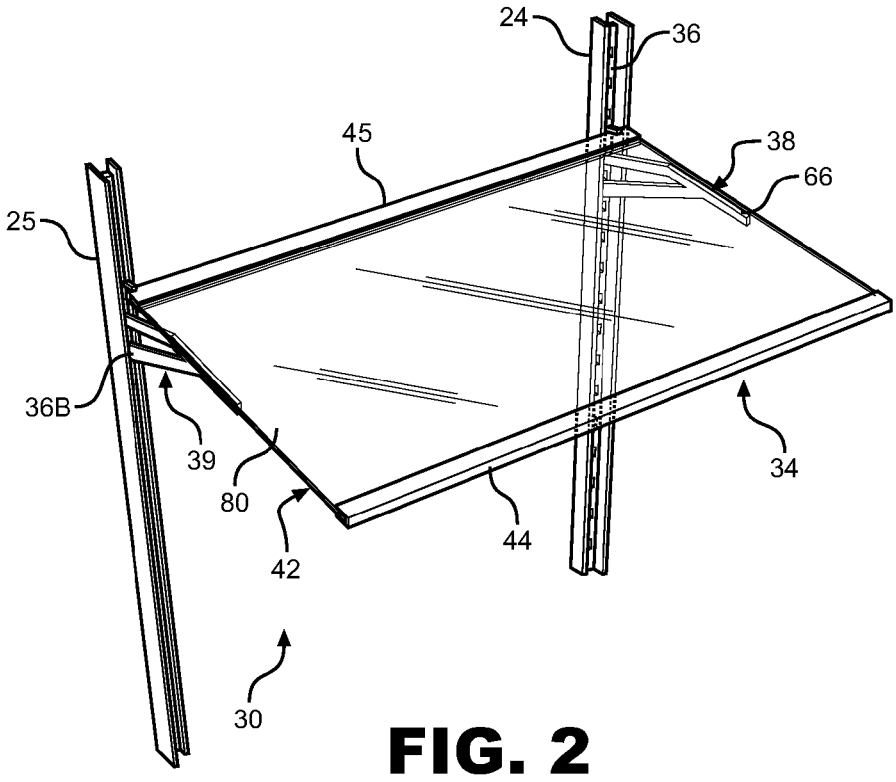
FIG. 2 is a perspective view of a refrigerator shelf system of the present invention.
Figure 3:
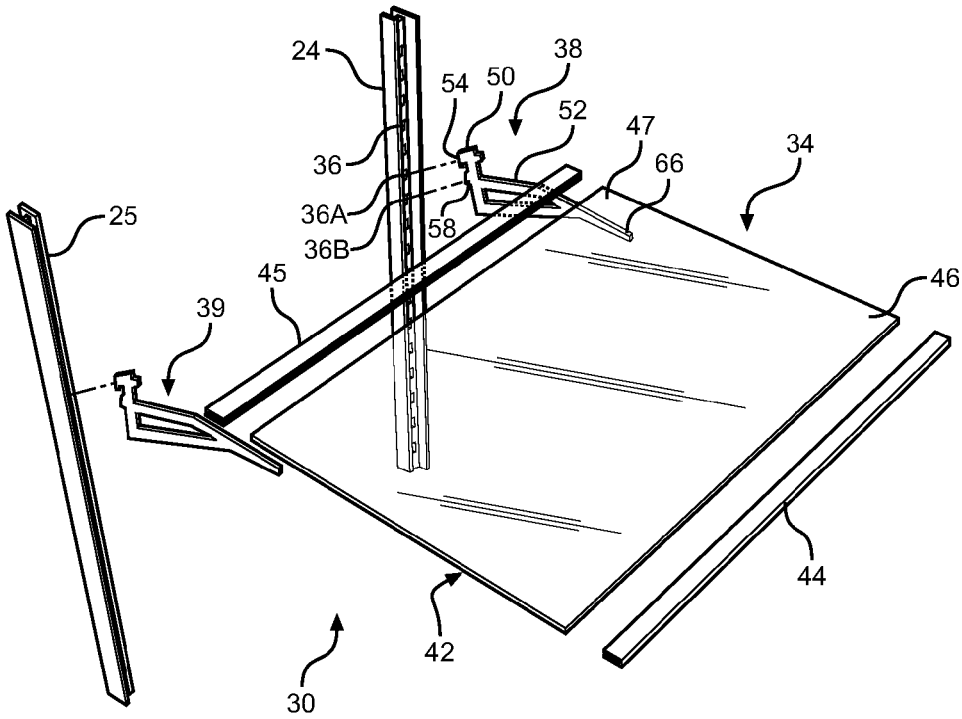
FIG. 3 is an exploded perspective view of the refrigerator shelf system of FIG. 2.

In general, aside from referenced shelving structure, the particular components of refrigerator 2 outlined above are known in the art, do not form part of the invention, and are described for the sake of completeness. Instead, the present invention is actually directed to a refrigerator shelf system 30 as best seen in FIG. 2. As shown, shelf system 30 includes laterally spaced rails 24 and 25 and a shelf assembly generally indicated at 34. In the preferred embodiment shown, each of laterally spaced rails 24 and 25 includes a plurality of longitudinally spaced apertures 36 formed therein. Preferably, laterally spaced rails 24 and 25 are mounted to liner 6 adjacent a back wall of fresh food or freezer compartment 8, 10 utilizing screws or other fasteners known in the art, as depicted in FIG. 1. With reference to FIGS. 2 and 3, shelf assembly 34 includes first and second shelf brackets 38 and 39, a planar shelf panel 42 having a top surface and a bottom surface, and front and back frame members 44 and 45. Preferably, front and back frame members 44 and 45, as well and first and second shelf brackets 38 and 39, are formed from metal, such as extruded aluminum. Adhesive is preferably utilized to affix front and back frame members 44 and 45 to opposing front and back edge portions 46 and 47 of planar shelf panel 42. The adhesive may be cured after assembly to improve the bond between shelf panel 42 and front and back frame members 44 and 45. Planar shelf panel 42 is preferably a tempered glass panel.

Figure 4:
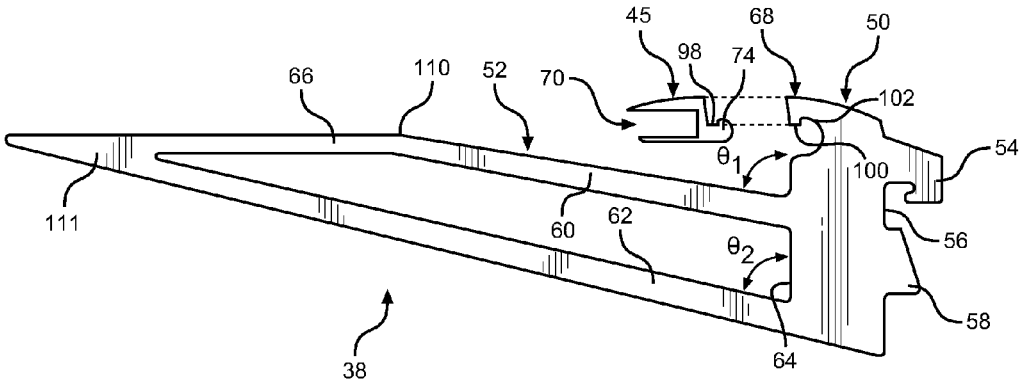
FIG. 4 is a side view of a shelf bracket employed with the shelf system of the present invention.

As best seen in FIG. 4, each of first and second shelf brackets 38 and 39 includes a main body 50 and a shelf support arm 52. At this point it should be understood that first and second shelf brackets 38 and 39 are identical in nature, such that only the details of shelf bracket 38 will be discussed herein for the sake of simplicity. Each of brackets 38 and 39 includes a bracket support hook 54 extending from an upper portion of a first side wall 56 of main body 50, and a tab member 58 extending from a lower portion of the first side wall 56. First and second support bars 60 and 62 extend at a respective angle ($\theta_1$, $\theta_2$) from a second side wall 64 of main body 50 and connect to a shelf support arm 66. Additionally, a hook-shaped shelf support flange 68 extends from second side wall 64 in the direction of shelf support arm 66.

In use, the first and second shelf brackets 38 and 39 are removably mounted on rails 24 and 25 via respective bracket support hooks 54 and tab members 58. For example, with reference to FIG. 3, bracket support hook 54 of shelf bracket 38 is inserted into a first aperture 36A of rail 24, and tab member 58 is inserted into a second aperture 36B of rail 24 directly below first aperture 36A. Hook 54 hooks over a portion of rail 24 defining aperture 36A, while tab member 58 extends into aperture 36B until first side wall 56 of shelf bracket 38 abuts rail 24. With this configuration, when shelf bracket 38 is mounted to rail 24, shelf support arm 66 is held substantially horizontal.

The manner in which planar shelf panel 42 is supported by shelf brackets 38 and 39 will now be discussed with reference to FIG. 4. Back frame member 45 includes a substantially U-shaped shelf panel interface portion 70 which receives back edge portion 47 of planar shelf panel 42. Back frame member 45 further includes at least one support hook 74 adapted to engage shelf support flanges 68 on respective first and second shelf brackets 38 and 39. More specifically, back frame member 45 is positioned in abutting relation with shelf support flange 68 and support hook 74 is hooked under shelf support flange 68 such that back frame member 45 and attached planar shelf panel 42 are supported by shelf support flange 68. As best seen in FIG. 2, when support hook 74 is engaged with shelf support flanges 68, back edge portion 47 is spaced from shelf support arms 66 while part of the bottom surface of a central portion 80 of planar shelf panel 42 rests on shelf support arms 66 of shelf brackets 38 and 39. In the preferred embodiment shown, both a section of central portion 80 and all of front edge portion 46 of shelf panel 42 extends, in a cantilevered manner, well beyond support arms 66 of respective first and second shelf brackets 38 and 39. With this arrangement, as depicted, a majority of shelf panel 42 can be cantilevered beyond support arms 66. However, it should be understood that the length of shelf panel 42 may vary without departing from the present invention.

In one preferred embodiment, support hook 74 defines a flange receiving portion 98, as depicted in FIG. 4. Similarly, each shelf support flange 68 defines a flange portion 100 and a hook receiving portion 102. When support hook 74 hooks under shelf support flange 68 of a respective one of shelf brackets 38 and 39, support hook 74 is received in hook receiving portion 102 and flange portion 100 is received in flange receiving portion 98. The downward force applied by planar shelf panel 42, particularly when loaded with items at front edge portion 46, is partially transferred to support hook 74 and shelf support flange 68 to lock planar shelf panel 42 to the respective shelf brackets 38 and 39, thereby preventing planar shelf panel 42 from sliding forward relative to shelf brackets 38 and 39 and causing part of central portion 80 to rest on support arms 66.

Figure 5:
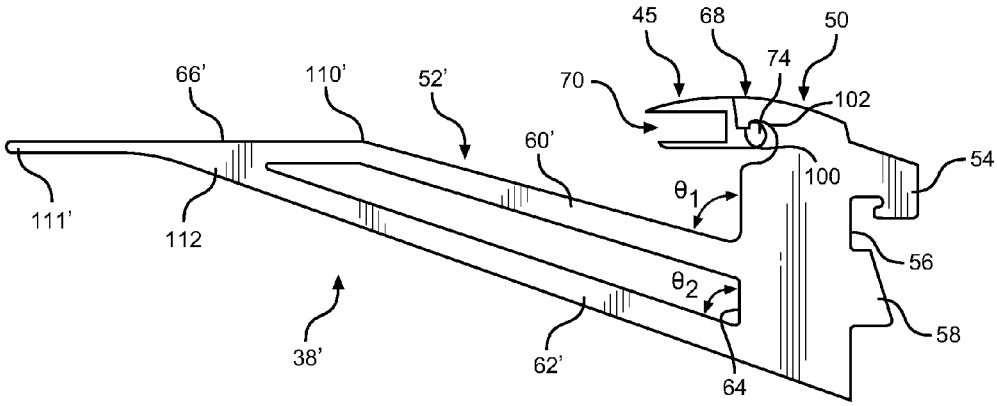
FIG. 5 is a side view of an alternative shelf bracket in accordance with the present invention.

It should be understood that shelf brackets 38 and 39 may include slight variations in form. For example, in a first embodiment depicted in FIG. 4, first support bar 60 is adjoined to a first end 110 of shelf support arm 66, while second support bar 62 joins directly with shelf support arm 66 at an end portion 111 of shelf support arm 66. In an alternative arrangement of FIG. 5, a shelf support arm 52' of a shelf bracket 38' includes a first support bar 60' adjoined to a first end 110' of a shelf support arm 66', while a second support bar 62' joins with shelf support arm 66' at a mid portion 112, such that a second end 111' of shelf support arm 66' extends beyond the first and second support bars 60' and 62'.

Advantageously, the shelf assembly of the present invention is reversible due to identical left and right sides. More specifically, first and second shelf brackets 38 and 39 have identical structure, and first and second laterally spaced support rails 24 and 25 have corresponding structure, such that first and second shelf brackets 38 and 39 are interchangeable with one another. Additionally, the shelf assembly of the present invention allows for the easy removal and cleaning of shelf panel 42 without the removal of the entire shelf bracket assembly. Further, the shelf brackets may accommodate a variety of shelf panel sizes and therefore, the shelf panel can be changed without changing the shelf brackets.

Although described with reference to preferred embodiments of the invention, it should be readily understood that various changes and/or modifications can be made to the invention without departing from the spirit thereof. For instance, although depicted in a side-by-side style refrigerator, it should be understood that the refrigerator shelf system of the invention may be readily incorporated into other styles of refrigerators, such as top and bottom-mount or French door-type refrigerators. In addition, two or more refrigerator shelf systems may be mounted to the back wall of a refrigerator adjacent one another, such that multiple rows of adjustable shelves are provided. Furthermore, although depicted as having a continuous support hook along the back frame member, two separate support hooks may be formed on opposing end portions of the back frame member to engage respective first and second shelf brackets in the same manner described above with respect to the continuous support hook. Finally, although separate shelf brackets are shown, the brackets could be interconnected to establish a unitary frame. In general, the invention is only intended to be limited by the scope of the following claims.

We claim:

1. A refrigerator comprising:

a cabinet shell including a food storage compartment having a back wall; and a shelf assembly including:

a first shelf bracket extending from the back wall, said first shelf bracket including a first shelf support flange and a first support arm;

a second shelf bracket extending from the back wall, said second shelf bracket including a second shelf support flange and a second support arm;

a shelf panel having a front edge portion, a back edge portion and a central portion between the front and back edge portions; and a back frame member including a shelf panel interface portion receiving the back edge portion of the shelf panel and attaching the back frame member to the back edge portion of the shelf panel, the back frame member further including at least one support hook, distinct from the shelf panel interface portion, extending rearward from the shelf panel interface portion and removably interengaged with the first and second support flanges at a position above a bottom surface of the shelf panel wherein, with the at least one support hook of the back frame member engaged with the first and second shelf support flanges of the first and second shelf brackets, the central portion of the shelf panel is supported on the first and second support arms of the first and second shelf brackets and the front edge portion of the shelf panel extends beyond the first and second shelf brackets in a cantilevered fashion.

2. The refrigerator according to claim 1, further comprising: a front frame member attached to the front edge portion of the shelf panel.

3. The refrigerator according to claim 1, further comprising: first and second laterally spaced support rails positioned adjacent the back wall of the food storage compartment, wherein:

each of the first and second laterally spaced support rails includes a plurality of vertically spaced apertures; and each of the first and second shelf bracket includes a main body, a bracket support hook extending from the main body and a tab member extending from the main body, with each of the first and second shelf bracket being hung from a respective one of the first and second support rails at selected ones of the plurality of vertically spaced apertures via the bracket support hook and the tab member.

4. The refrigerator of claim 3, wherein the first and second shelf brackets have identical structure, and the first and second laterally spaced support rails have identical structure, such that the first and second shelf brackets are interchangeable with one another and the first and second laterally spaced support rails are interchangeable with one another.

5. The refrigerator according to claim 1, wherein each of the first and second shelf brackets further comprises:

a main body from which the first and second shelf support flanges extend;

a first support bar extending at a first angle from the main body at a first end and joined to a respective one of the first and second support arms at a second end; and a second support bar extending at a second angle from the main body at a first end and connected to the respective one of the first and second support arms at a second end.

6. The refrigerator according to claim 5, wherein the central portion of the shelf panel is maintained vertically spaced from the first and second support bars of each of the first and second shelf brackets.

7. The refrigerator of claim 6, wherein each of the first and second support arms extends beyond the first and second support bars.

8. A refrigerator comprising:

a cabinet shell including a food storage compartment having a back wall; and a shelf assembly including:

a first shelf bracket projecting away from the back wall, said first shelf bracket including a first shelf support flange and a first support arm;

a second shelf bracket projecting away from the back wall at a position spaced from the first shelf bracket, said second shelf bracket including a second shelf support flange and a second support arm, with each of the first and second shelf brackets further including:

a main body from which a respective one of the first and second shelf support flanges extends;

a first support bar extending at a first angle from the main body at a first end and joined to a respective one of the first and second support arms at a second end; and a second support bar extending at a second angle from the main body at a first end and connected to the respective one of the first and second support arms at a second end;

a shelf panel having a front edge portion, a back edge portion and a central portion between the front and back edge portions; and a back frame member attached to the back edge portion of the shelf panel, the back frame member being interengaged with the first and second support flanges with part of the central portion of the shelf panel being supported on the first and second support arms, the back edge portion of the shelf panel being spaced vertically from the first and second support bars of each of the first and second brackets and forward of upper edges of the first and second support flanges and both a section of the central portion and the front edge portion of the shelf panel extending beyond the first and second support arms.

9. The refrigerator according to claim 8, further comprising: a front frame member attached to the front edge portion of the shelf panel.

10. The refrigerator according to claim 8, wherein the front edge portion of the shelf panel extends beyond the first and second shelf brackets in a cantilevered fashion.

11. The refrigerator according to claim 8, further comprising:

first and second laterally spaced support rails positioned adjacent the back wall of the food storage compartment, each of the first and second laterally spaced support rails including a plurality of vertically spaced apertures and each of the first and second shelf bracket including a main body, a bracket support hook extending from the main body and a tab member extending from the main body, with each of the first and second shelf bracket being hung from a respective one of the first and second support rails at selected ones of the plurality of vertically spaced apertures via the bracket support hook and the tab member.

12. The refrigerator according to claim 11, wherein the first and second shelf brackets have identical structure, and the first and second laterally spaced support rails have identical structure, such that the first and second shelf brackets are interchangeable with one another and the first and second laterally spaced support rails are interchangeable with one another.

13. The refrigerator according to claim 8, wherein each of the first and second support arms extends beyond the first and second support bars.

14. A method of assembling a repositionable shelving system in a refrigerator having a cabinet shell, a food storage compartment and a shelf assembly including a shelf panel including a back frame member, the method comprising:

mounting first and second shelf brackets, each including a shelf support flange and a shelf support arm, within the food storage compartment such that each of the first and second shelf brackets extend, at spaced positions, away from a back wall of the food storage compartment;

engaging at least one support hook provided on the back frame member rearward of the shelf panel with respective shelf support flanges of the first and second shelf brackets such that a back edge portion of the shelf panel is hooked to the shelf support flanges; and supporting a central portion of the shelf panel on respective shelf support arms of the first and second shelf brackets, while a front edge portion of the shelf panel extends beyond the first and second shelf brackets in a cantilevered manner.

15. The method of claim 14, further comprising: maintaining a portion of the shelf panel, between the shelf support arms and the shelf support flanges, vertically spaced above the first and second shelf brackets.

16. The method of claim 15, wherein mounting the first and second shelf brackets constitutes:

inserting a bracket support hook of the first shelf bracket into a first slot formed in a first support rail provided adjacent the back wall;

inserting a tab member extending from the first shelf bracket into a second slot formed in the first support rail below the first slot to secure the first shelf bracket to the first support rail;

inserting a bracket support hook of the second shelf bracket into a first slot formed in a second support rail provided adjacent the back wall; and inserting a tab member extending from the second shelf bracket into a second slot formed in the second support rail below the first slot to secure the second shelf bracket to the second support rail.

17. The method of claim 14, wherein the back edge portion of the shelf panel is hooked to the shelf support flanges at a position above a bottom surface of the shelf panel.

18. The method of claim 14, wherein the back frame member is formed separate from the shelf panel, with the back frame member being fully connected to the shelf panel prior to engaging the at least one support hook on the back frame member with the shelf support flanges.

19. The method of claim 14, wherein the at least one support hook extends rearward of the shelf panel for hooking onto the shelf support flanges.

20. The refrigerator according to claim 1, wherein the at least one support hook extends rearward of the shelf panel interface portion.

* * * * *